United States Patent [19]

Brandt et al.

[11] 4,231,317

[45] Nov. 4, 1980

[54] BOAT PROPELLER DEVICE

[75] Inventors: Lennart H. Brandt, Fjärås; Staffan T. Månsson, Hjälteby, both of Sweden

[73] Assignee: AB Volvo Penta, Goteborg, Sweden

[21] Appl. No.: 49,649

[22] Filed: Jun. 19, 1979

[30] Foreign Application Priority Data

Jul. 19, 1978 [SE] Sweden ..... 7807965

[51] Int. Cl.[3] ..... B63H 3/02

[52] U.S. Cl. ..... 440/50; 416/149; 416/166; 416/137

[58] Field of Search ..... 416/137, 149, 163, 164, 416/166, 152, 49, 31, 112; 115/18 R, 34 R, 35

[56] References Cited

U.S. PATENT DOCUMENTS

| | | | |
|---|---|---|---|
| 3,275,083 | 9/1966 | Allin | 416/149 |
| 3,302,725 | 2/1967 | Brimble et al. | 416/43 |
| 3,534,703 | 10/1970 | Eckman | 115/35 |
| 3,552,348 | 1/1971 | Shima | 115/35 |

FOREIGN PATENT DOCUMENTS

| | | | |
|---|---|---|---|
| 317601 | 11/1969 | Sweden | 115/34 R |

*Primary Examiner*—Trygve M. Blix
*Assistant Examiner*—Jesus D. Sotelo
*Attorney, Agent, or Firm*—Young & Thompson

[57] ABSTRACT

The invention relates to a boat propeller having rotatably journalled blades in its hub to enable shifting between forward and reverse without reversing the direction of rotation. The hub is rotatably journalled on the propeller shaft and contains a transmission between the shaft and the blades. The transmission can be coupled between positions for forward, reverse and neutral. The invention uses the torque of the motor and the reaction moment of the water against the blades to achieve a relative rotation between the shaft and the hub, whereby the transmission turns the blades to one of two stops, which define the positions for forward or reverse.

6 Claims, 4 Drawing Figures

Figure 1:
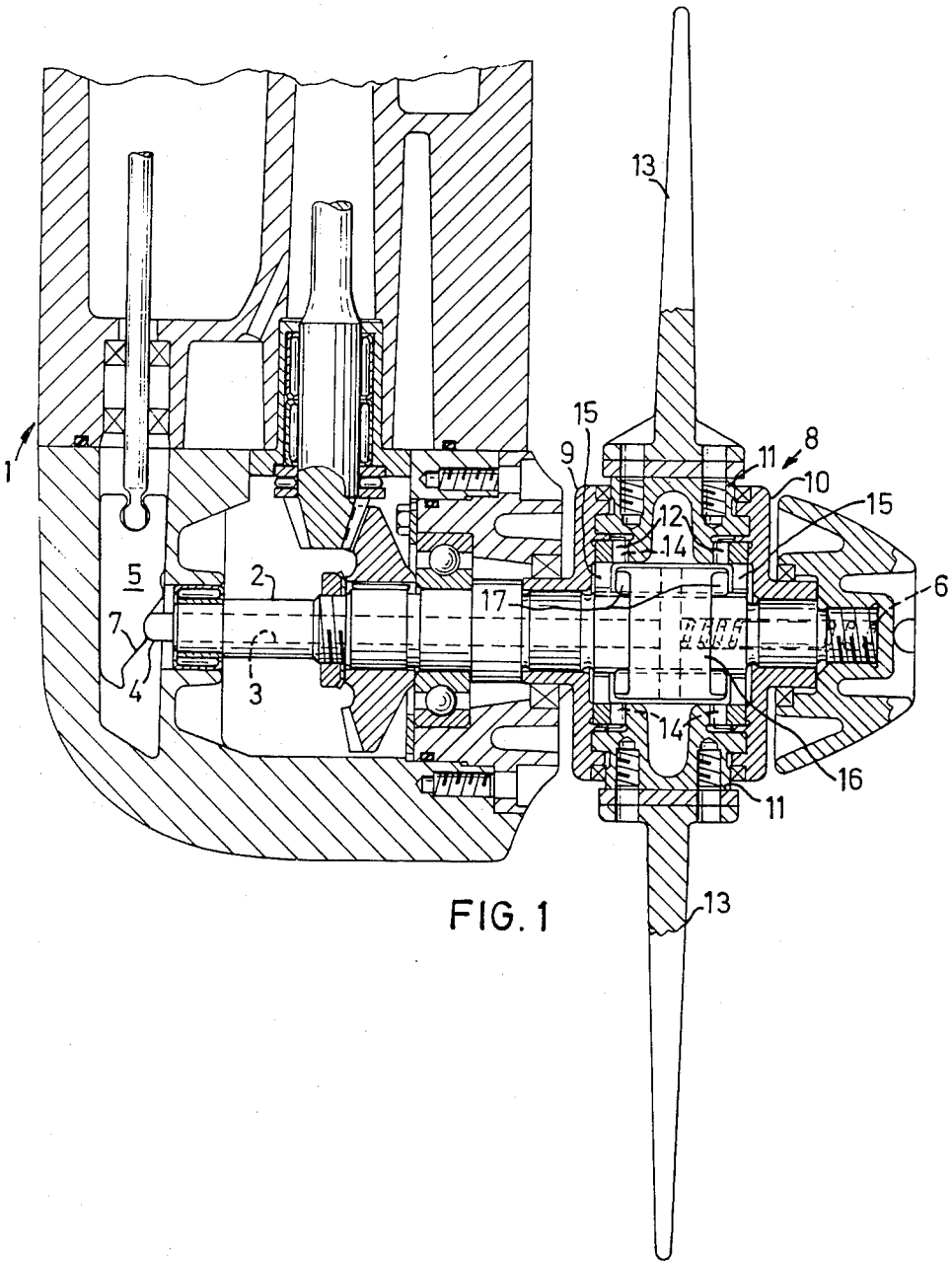

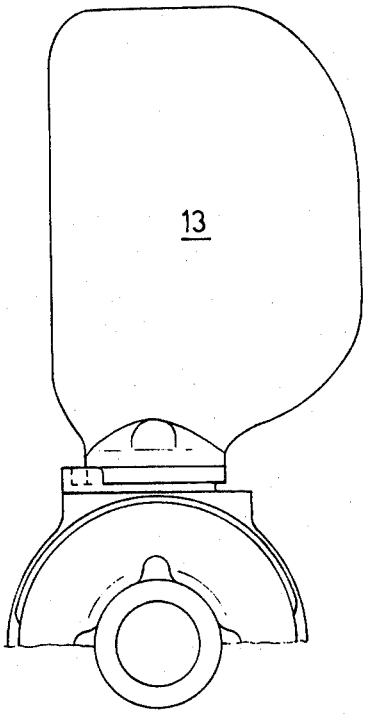
FIG. 2
FIG. 3
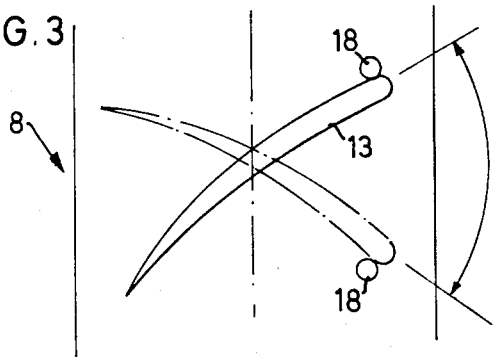
FIG. 4
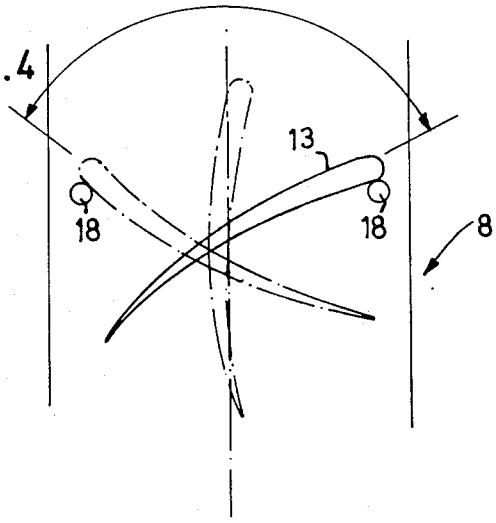

BOAT PROPELLER DEVICE

The present invention relates to a boat propeller device comprising a hub and blades rotatably journalled in the hub.

Maneuvering a boat, especially a ship, between forward and reverse involves significant technical problems. In a propeller with fixed blades, if the thrust of the propeller is changed by changing its direction of rotation, the kinetic energy of the propeller must be absorbed in a very short time at the same time as new energy must be imparted to achieve reversed rotation. As a result of the short time periods, the shaft systems, couplings etc. are subjected to large stresses, and shock loads which can easily arise must then be evened out by means of friction clutches, rubber members, maximum torque couplings etc.

Even propellers with turnable blades are subjected to large forces, not only forces from the surrounding water, but also significant gyral forces and torque caused by the obliquity, width and rotation of the blades. These gyral forces can be quite large. For a common motor installation with outboard drive and a light metal propeller, the gyral torque is approximately in the range of 40–50 Nm at maximum r.p.m. (40 Hz) for the propeller.

Thus, in order to be able to turn propeller blades which are turnably journalled on a rotating hub, significant forces and torque are required, which are usually produced with the aid of hydraulic systems, which are quite expensive and complicated.

The purpose of the present invention is to obtain a propeller device which in a simple and inexpensive manner solves the problem of achieving sufficiently large maneuvering forces to change the angle of the blades.

This is achieved according to the invention by the blades being turnable between two end positions, one of which determines the setting of the blades for propulsion in a first direction with a certain direction of rotation of the hub, and the second end position determines the setting of the blades for propulsion in the opposite direction with the same direction of rotation, the hub being rotatably journalled on a propeller shaft and transmission means being disposed between the shaft and the blades, said means being selectively engagable so that, when there is a relative rotation between the hub and the shaft, the blades turn to one of said end positions.

The propeller device according to the invention uses the torque of the motor and the reaction moment from the water acting on the blades as the propeller rotates to achieve the reversal of the setting of the blades between forward and reverse. This results in a relatively simple mechanical construction which is located in the hub and is made up of simple conventional components. At the same time, the propeller shaft system is not subjected to shock torque when shifting between forward and reverse, since the rotational direction of the propeller and speed need not be changed.

The invention is described here in more detail with reference to the accompanying drawings showing examples, in which FIG. 1 shows a longitudinal section through the lower portion of an outboard drive unit with a propeller device according to the invention, FIG. 2 is a stern-on view of the propeller device in FIG. 1, FIG. 3 is a schematic view from above of the hub and a blade, illustrating the reversing angle of the blade, and FIG. 4 is a view corresponding to FIG. 3 illustrating the reversing angle of the blade in an alternative embodiment.

FIG. 1 shows the lower portion of an outboard drive unit 1, whose general design can be conventional and therefore need not be described in more detail. A propeller shaft 2 is rotatably journalled in the drive unit housing and has a central bore 3, in which a control rod 4 is displacably journalled. The left-hand end of the rod 4 is pressed against a cam member 5 by a spring 6 disposed in the right-hand portion of the bore. The cam member 5 is connected to a shift control (not shown) and has a cam curve 7 with three stops which define the shift positions forward, neutral and reverse, which will be described further on.

On the propeller shaft 2, there is a propeller hub 8 rotatably journalled, which consists of two hub halves 9 and 10. In the hub 8, a pair of diametrically opposed bearing spindles 11 are rotatably journalled, which are made with gear rings 12.

A propeller blade 13 is screwed securely to each bearing spindle. A pair of gears 14, freely rotatably journalled on the propeller shaft, engage the gear rings 12 at diametrically opposed locations. The sides of the gears 14, which face one another, are made with coupling teeth 15. A coupling sleeve 16 is displacably journalled on the propeller shaft between the gears 14. The coupling sleeve 16 has coupling teeth 17 for engaging the teeth 15 of the gears and it is joined to the control rod 4 by means of a pin which extends through a slot in the shaft 2. In this manner, the coupling sleeve is fixed for rotation together with the propeller shaft at the same time as it is axially displacable on the shaft. In the position of the coupling sleeve 16 shown in FIG. 1 (neutral), the two gears 14 are both freely rotatable on the shaft 2. By sliding the sleeve 16 to the right or left from the position shown, so that its coupling teeth 17 are brought into engagement with the corresponding coupling teeth 15 on the respective gear 14, one of the gears 14 can be locked onto the propeller shaft 2.

If, for example, the coupling sleeve 16 is moved to the right from the position in FIG. 1 by moving the cam member 5 downwards, so that the end of the control rod 4 lies against the uppermost step of the cam curve 7, the right-hand gear 14 is locked to the shaft 2. As the shaft rotates, a torque will be transferred from the shaft via the right-hand gear 14 to the gear rings 12, turning the blades a certain angle, which is determined by one of two stop lugs 18, as is shown more clearly in FIG. 3. If the shaft 2 rotates clockwise, as seen stern-on, the blades will be set as shown in FIG. 3 with solid lines for forward propulsion. When the left-hand gear 14 is locked to the shaft in the corresponding manner, thereby releasing the right-hand gear 14, the blades are turned as indicated with the dash-dot lines in FIG. 3 for reverse.

In the embodiment just described, the blades move the smallest possible angle between forward and reverse. In an alternative embodiment, as indicated schematically in FIG. 4, the stop lugs 18 are arranged in such a way that the blades turn the greatest possible angle between forward and reverse. Thus the blades pass through a plane through the propeller shaft. This embodiment is especially suite to sailboats, because the blades can be vaned during sailing for the minimum resistance in the water. The reverse propulsion capacity is then somewhat different in the two cases, due to the fact that in the first case the flow is against the nose portion and the convex side of the blade (normally the suction side) in reverse, while in the second case the flow is against the sharp back edge of the blade and its concave side (normally the driving side).

The embodiment described provides a propeller device, which in a simple manner can be set for forward, reverse and neutral. In a further development of the invention, one can also make a propeller which can be driven with variable pitch. In principle, this is done by making the positions for the stops 18 variable, for example by arranging the stops on rotatable wheels in the housing with positions determined in some appropriate manner, for example by the position of the throttle.

What we claim is:

1. Boat propeller device comprising a hub and blades rotatably journalled in the hub, characterized in that the blades are turnable between two end positions, one end position determining the setting of the blades for propulsion in a first direction with a certain direction of rotation of the hub, and the second end position determining the setting of the blades for propulsion in the opposite direction with the same direction of rotation, the hub being rotatably journalled on a propeller shaft and transmission means being disposed between the shaft and the blades said means being selectively engagable so that when there is a relative rotation between the hub and the shaft, the blades turn to one of said end positions.

2. Boat propeller device according to claim 1, characterized in that the transmission means include two axially spaced gears journalled so as to be freely rotatable on the propeller shaft, a gear fixedly joined to each propeller blade, said two first-mentioned gears engaging said second-mentioned gear at diametrically opposed locations, and a coupling device for selective locking of either one of the two first-mentioned gears to the shaft or for releasing of both from the shaft.

3. Boat propeller device according to claim 1 or 2, characterized in that said end positions are defined by two end stops which are arranged so that the blades turn the smallest possible angle between the end positions.

4. Boat propeller device according to claim 1 or 2, characterized in that said end positions are defined by two end stops which are arranged so that the blades turn the greatest possible angle between the end positions and thereby pass through a plane parallel to the propeller shaft.

5. Boat propeller device according to claim 2, characterized in that the coupling device is maneuverable by means of a control rod which is axially displacable in a central bore in the propeller shaft.

6. Boat propeller device according to claim 5, characterized in that the control rod is joined to a coupling sleeve which is non-rotatable but axially displacable on the shaft, said sleeve being arranged between the gears which are rotatably journalled on the shaft and also have coupling surfaces for engaging the corresponding surfaces on the gear sides which face each other.

* * * * *